US006798319B2

(12) United States Patent
Aikawa et al.

(10) Patent No.: US 6,798,319 B2
(45) Date of Patent: Sep. 28, 2004

(54) HIGH-FREQUENCY FILTER

(75) Inventors: Masayoshi Aikawa, 26-11, Nara 2-chome, Aoba-ku, Yokohama, Kanagawa (JP); Eisuke Nishiyama, Saga (JP); Yoshifumi Kawamura, Kanagawa (JP); Fumio Asamura, Saitama (JP); Takeo Oita, Saitama (JP)

(73) Assignees: Nihon Dempa Kogyo Co., Ltd., Tokyo (JP); Masayoshi Aikawa, Kanagawa (JP)

( * ) Notice: Subject to any disclaimer, the term of this patent is extended or adjusted under 35 U.S.C. 154(b) by 0 days.

(21) Appl. No.: 10/262,909

(22) Filed: Oct. 2, 2002

(65) Prior Publication Data

US 2003/0102942 A1 Jun. 5, 2003

(30) Foreign Application Priority Data

Oct. 3, 2001 (JP) ..... 2001-307990

(51) Int. Cl.[7] ..... H01P 1/20

(52) U.S. Cl. ..... 333/204; 333/219; 333/205; 333/246

(58) Field of Search ..... 333/205, 202, 333/175, 204, 219, 246, 995

(56) References Cited

U.S. PATENT DOCUMENTS 3,688,225 A * 8/1972 Cohn ..... 333/204
3,772,599 A * 11/1973 Ernst et al. ..... 455/327
3,939,430 A * 2/1976 Dickens et al. ..... 455/302
4,361,819 A * 11/1982 Sillard et al. ..... 333/109
4,642,584 A * 2/1987 Funck et al. ..... 333/17.2
H432 H * 2/1988 Mariani et al. ..... 333/205
5,321,374 A * 6/1994 Uwano ..... 333/202
5,448,211 A * 9/1995 Mariani ..... 333/205
6,097,263 A * 8/2000 Mueller et al. ..... 333/17.1

* cited by examiner

*Primary Examiner*—Robert Pascal
*Assistant Examiner*—Kimberly E Glenn
(74) *Attorney, Agent, or Firm*—Katten Muchin; Zavis Rosenman

(57) ABSTRACT

A high-frequency filter for use in a superhigh frequency band such as of microwaves and millimeter waves has a substrate, a metal conductor disposed on a first main surface of the substrate, a resonator comprising a transmission line of a coplanar structure which is made of the metal conductor, and input and output lines disposed on a second main surface of the substrate transversely across the resonator and electromagnetically coupled to the resonator. The resonator may be a coplanar line resonator (coplanar waveguide resonator) or a slot line resonator. The high-frequency filter has a steep attenuating gradient in filter characteristics. The high-frequency filter may be combined with variable-reactance devices such as variable-capacitance diodes for electronically controlling the filter characteristics.

15 Claims, 6 Drawing Sheets

HIGH-FREQUENCY FILTER

BACKGROUND OF THE INVENTION

1. Field of the Invention

The present invention relates to a high-frequency filter for use in a superhigh frequency band (generally from 1 to 100 GHz) such as of microwaves and millimeter waves, and more particularly to a high-frequency filter having a microwave integrated circuit structure and capable of electronically controlling filter characteristics such as transmission characteristics, in particular, band characteristics.

2. Description of the Related Art

High-frequency filters are widely used as a functional device indispensable for introducing and extracting desired signals and suppressing and removing unwanted signals in transmission/reception apparatus in various radio communication facilities, optical fiber high-speed transmission apparatus, and measuring devices in association therewith.

Heretofore, high-frequency filters for use in the microwave band and higher frequency bands are generally constructed using metal waveguides or dielectric resonators. In recent years, high-frequency filters having a microwave integrated circuit structure are also finding growing use for their small size. However, high-frequency filters of a microwave integrated circuit structure generally have fixed filter characteristics and suffer limitations in general-purpose applications. There have been proposed high-frequency filters of a microwave integrated circuit structure capable of electronically controlling filter characteristics, as reported in academic societies.

FIG. 1 shows a conventional high-frequency filter having a microwave integrated circuit structure. As shown in FIG. 1, the high-frequency filter basically has a resonator comprising a transmission line formed on substrate 1 which is made of, for example, a dielectric material. In FIG. 1, the transmission line comprises microstrip lines. Specifically, the transmission line includes a plurality of (e.g., three) signal lines 2 and input and output lines 3, 4, each made of a metal conductor, arranged at transversely spaced intervals on one main surface of substrate 1. Signal lines 2 are sandwiched between input and output lines 3, 4, and signal lines 2 and input and output lines 3, 4 are closely positioned so that they are electromagnetically coupled. A ground conductor, i.e., a metal conductor for grounding purpose, is placed as a ground plane on the other main surface of substrate 1.

Each of signal lines 2 is divided into signal line segments 2*a*, 2*b* that are connected to each other by a voltage-variable capacitance element such as variable-capacitance diode 6, for example. A control voltage is applied to variable-capacitance diodes 6 via LPF (low-pass filter) 5. The ends of signal line segments 2*a* remote from respective variable-capacitance diodes 6 are connected to the ground conductor on the other main surface of substrate 1 through respective via holes (through electrode holes) 7 or the like. LPF 5 serves to block high-frequency signals and pass the control voltage therethrough.

With the high-frequency filter, if the resonant frequency has a wavelength of $\lambda$, then the length of each of signal lines 2, which comprises a microstrip line, is set to approximately $\lambda/4$, making each of signal lines 2 function as a resonator. Since the variable-capacitance diode 6 is inserted in each microstrip line, i.e., signal line 2, and the capacitance across the variable-capacitance diode 6 varies depending on the control voltage applied thereto, the resonant frequency of the resonator is variable. This resonator structure can be constructed in a smaller size than dielectric resonators, allowing each resonator to be used in general-purpose applications and to be practical in use.

Because the microstrip lines, i.e., signal lines 2, are arranged at transversely spaced intervals, thus connecting the resonators in cascade, the attenuation slope in the band characteristics of the high-frequency filter can be made steep by equalizing the resonance frequencies of the respective resonators. The high-frequency filter can therefore be used as a practical high-frequency filter. If input and output lines are connected to each individual resonator, i.e., each signal line 2, then the resultant high-frequency filter has a relatively gradual attenuation slope.

With the conventional high-frequency filter described above, the end of each signal line 2 as a microstrip line remote from variable-capacitance diode 6 is connected to the ground conductor on the other main surface of substrate 1 through via hole 7 which needs to be formed by a perforating process. In addition, LPF 5 is required to isolate the high-frequency signal and the control voltage from each other. For these reasons, the conventional high-frequency filter suffers drawbacks that make it difficult to produce the high-frequency filter in smaller sizes with increased accuracy at increased productivity. Specifically, the inductive component tends to increase due to the conductor length (line length) through each via hole 7, thereby degrading the high-frequency characteristics of the filter, and the characteristics of the filter are liable to differ owing to manufacturing errors of via holes 7.

SUMMARY OF THE INVENTION

It is therefore an object of the present invention to provide a high-frequency filter which has a steep attenuation slope, has filter characteristics electronically controllable, can be manufactured with increased accuracy at increased productivity, and is suitable for small-size designs.

According to the present invention, the above object can be achieved by a high-frequency filter comprising a substrate, a metal conductor disposed on a first main surface of the substrate, a resonator comprising a transmission line of a coplanar structure which is made of the metal conductor, and input and output lines disposed on a second main surface of the substrate transversely across the resonator and electromagnetically coupled to the resonator.

The substrate comprises a dielectric substrate, for example. The resonator as the transmission line of the coplanar structure is disposed on a first main surface of the substrate, and input and output signal lines extending across the resonator and electromagnetically coupled to the resonator are disposed on a second main surface of the substrate. The high-frequency filter produces a new resonant (frequency) point determined by the opposite ends of the resonator (i.e., transmission line) and points where the input and output lines cross the resonator. Since the length determining the resonant point is shorter than the transmission line, the frequency due to the resonant point is higher than the resonant frequency due to the transmission line (i.e., resonator). Therefore, an attenuating pole is produced in a high-frequency range of band characteristics of the resonator, with the result that a steep attenuation gradient is developed in the band characteristics of the high-frequency filter.

If variable-reactance elements such as variable-capacitance diodes are connected to the resonator, then the resonant frequency can be changed, so that the filter characteristics can electronically be controlled.

Since it is not necessary to provide via holes or the like, the high-frequency filter according to the present invention can be fabricated with increased accuracy at increased productivity, and can be reduced in size.

DETAILED DESCRIPTION OF THE INVENTION

Figure 1:
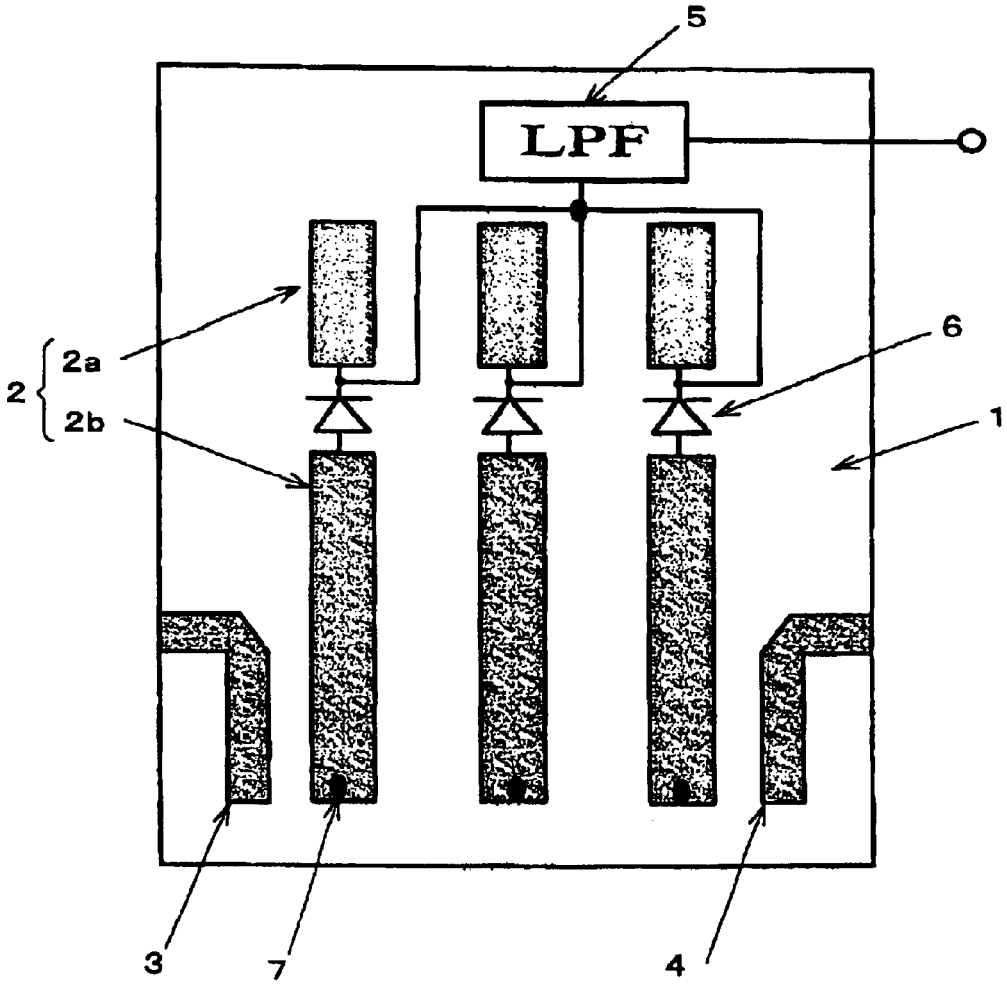
FIG. 1 (BACKGROUND ART)
FIG. 1 is a plan view of a conventional high-frequency filter.
Figure 2A:
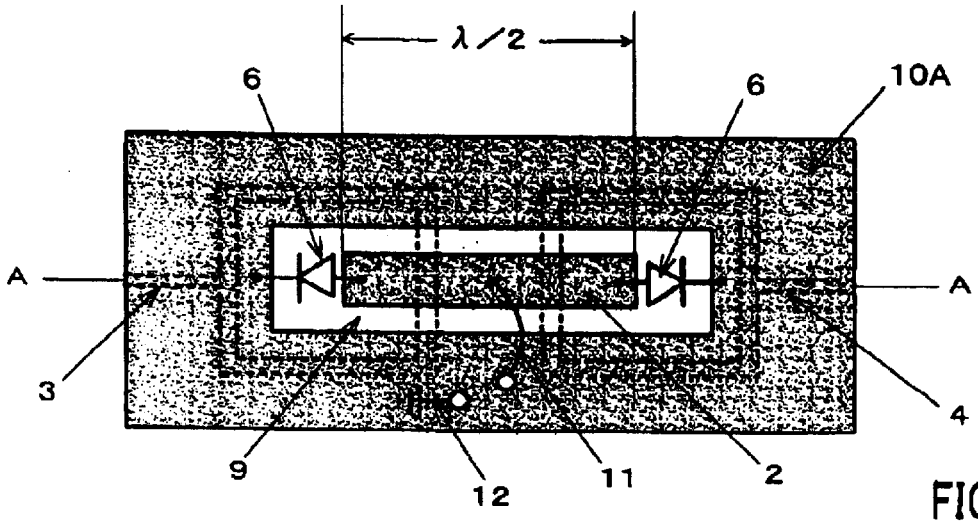
FIGS. 2A and 2B are a plan view and a cross-sectional view of a high-frequency filter according to a first embodiment of the present invention.
Figure 2B:
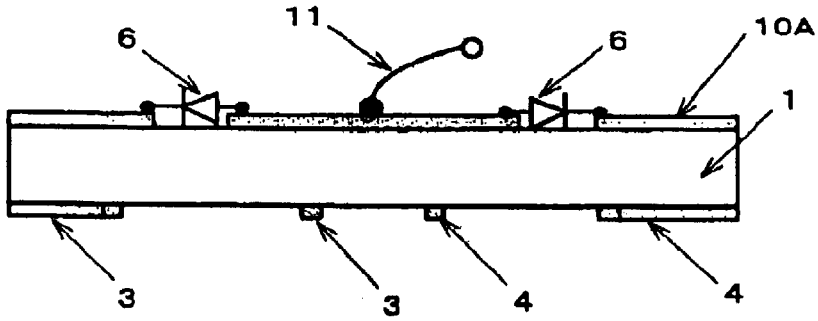

FIGS. 2A and 2B show a high-frequency filter according to a first embodiment of the present invention. FIG. 2B is a cross-sectional view taken along line B—B of FIG. 2A. The high-frequency filter has a substrate 1 made of a dielectric material. A resonator comprising a transmission line is mounted on one main surface of substrate 1. No ground conductor is mounted on the other main surface of substrate 1, unlike the conventional high-frequency filter shown in FIG. 1. The illustrated high-frequency filter has a resonator which has a coplanar structure, and the transmission line comprises a transmission line of a coplanar line structure or coplanar waveguide structure. The resonator with such a coplanar structure will hereinafter referred to as a CPW (CoPlanar Waveguide) resonator. The coplanar structure refers to a structure in which the transmission line is in the form of a metal conductor formed on one main surface of the substrate. Therefore, the transmission line comprising microstrip lines as shown in FIG. 1 is not of a coplanar structure because it has signal lines on one main surface of the substrate and additionally requires a ground conductor on the other main surface of the substrate.

The high-frequency filter includes ground conductor 10A disposed on the one main surface of substrate 1 and having rectangular opening 9 defined therein. Signal line 2 which comprises a metal conductor of the same material as ground conductor 10A extends in the longitudinal direction of opening 9 and is disposed in opening 9. The transmission line in the form of the coplanar line, i.e., coplanar waveguide, is constructed of ground conductor 10A disposed on the one main surface of substrate 1 and signal line 2 disposed in opening 9 defined in ground conductor 10A. The CPW resonator is made up of signal line 2 whose length is about $\lambda/2$ where $\lambda$ represents the wavelength corresponding to the desired resonant frequency. Signal line 2 has its opposite ends spaced from ground conductor 10A at the opposite ends (left and right ends as shown) of opening 9, and electrically functioning as open ends. The coplanar transmission line is an unbalanced transmission line in which a high-frequency signal progresses under an electric field-generated between signal line 2 and ground conductor 10A and a magnetic field generated due to the electric field.

Variable-capacitance diodes 6 are disposed on the one main surface of substrate 1 at the respective ends of opening 9. In the illustrated embodiment, variable-capacitance diodes 6 are connected by soldering between the ends of signal line 2 and the opposing edges of ground conductor 10A at the respective ends of opening 9, with the anodes of variable-capacitance diodes 6 being connected to signal line 2. Supply line 11 for applying a control voltage to variable-capacitance diodes 6 has an end connected to the CPW resonator, i.e., signal line 2, at a longitudinal midpoint thereof which divides signal line 2 into equal lengths. Ground line 12, which is paired with supply line 11, is connected to ground conductor 10A.

Input line 3 and output line 4 are mounted on the other main surface of substrate 1 at respectively positions corresponding to the opposite ends of signal line 2. Input line 3 comprises a closed loop surrounding a left-end portion (as shown) of signal line 2 and an extension extending from the closed loop to the left end (as shown) of substrate 1. The closed loop of input line 3 extends transversely across signal line 2 near the left end thereof, and is disposed in surrounding relation to one of variable-capacitance diodes 6. Similarly, output line 4 comprises a closed loop surrounding a right-end portion (as shown) of signal line 2 and an extension extending from the closed loop to the right end (as shown) of substrate 1. The closed loop of output line 4 extends transversely across signal line 2 near the right end thereof, and is disposed in surrounding relation to the other variable-capacitance diode 6. Input line 3 and output line 4 cooperate with ground conductor 10A in forming microstrip lines, which are electrically connected to the coplanar line as the resonator by electromagnetic coupling.

Figure 3:
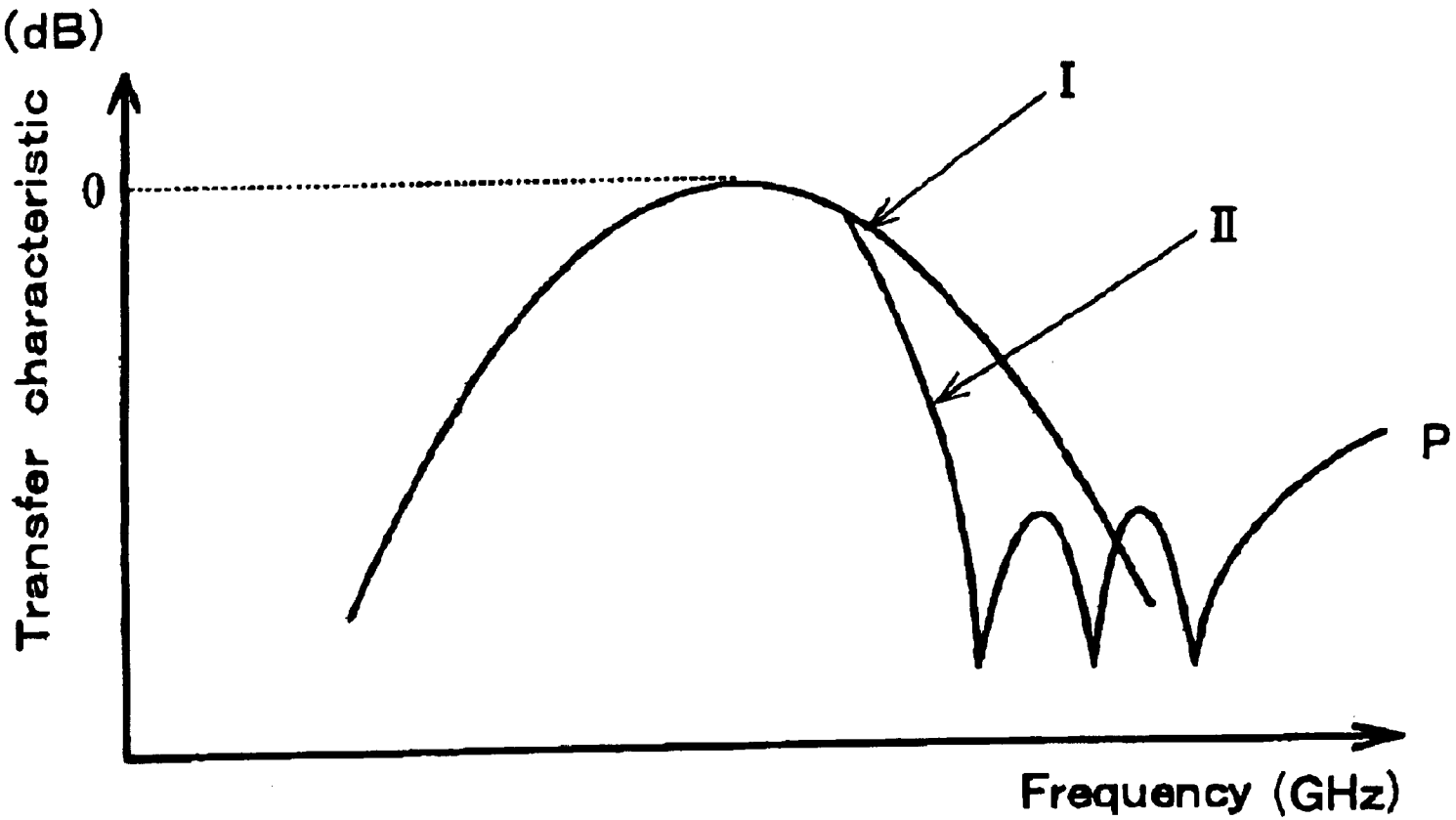
FIG. 3 is a diagram showing filter characteristics of the high-frequency filter according to the first embodiment.

With the high-frequency filter thus constructed, a plurality of new resonant points are produced as input/output resonant points on the high-frequency filter depending on a boundary condition based on the positions of input line 3 and output line 4 disposed on the other main surface of substrate 1 and extending transversely across the CPW resonator, e.g., the length between input line 3 and the end of signal line 2. Since the length which determines these input/output resonant points is shorter than the transmission line of the CPW resonator, i.e., the length of signal line 2, the resonant frequency at the input/output resonant points is higher than the resonant frequency of the CPW resonator. Therefore, as shown in FIG. 3, an attenuating pole P is formed in a high-frequency range of the band characteristics (represented by the curve I) of the CPW resonator, with the result that the transmission characteristic curve of the overall high-frequency filter is expressed as the curve II, making the attenuation gradient steeper.

Because variable-capacitance diodes 6 are connected between the opposite ends of the CPW resonator, i.e., the opposite ends of signal line 2, and ground conductor 10A, the resonant frequency is made variable by changing the capacitances of variable-capacitance diodes 6 with the control voltage applied thereto. Since variable-capacitance diodes 6 are positioned in an electric field generated between signal line 2 and ground conductor 10A, the electric length of signal line 2 is equivalently changed when the capacitances of variable-capacitance diodes 6 are changed.

In the illustrated embodiment, since the resonator is arranged in the coplanar structure as the coplanar line, the opposite terminals of variable-capacitance diodes 6 can be connected in one plane, and hence variable-capacitance diodes 6 can be surface-mounted. Unlike the conventional high-frequency filter shown in FIG. 1 which employs microstrip lines, it is not necessary to form via holes 7 in substrate 1 according to a perforating process. As any inductive components which would otherwise be caused by via holes 7 are negligible, the high-frequency filter according to the present embodiment can be designed and manufactured with ease, and can be fabricated with increased accuracy at increased productivity.

The control voltage is applied to signal line 2 of the coplanar line structure at the midpoint which divides signal line 2 into two equal lengths. The midpoint is a midpoint on a half-wavelength line, and serves as a null point in voltage changes. Since the control voltage is applied to the null point, any effect that the application of the control voltage has on the resonance characteristics can be ignored. Consequently, an LPF which has heretofore been necessary to isolate the high-frequency signal and the control voltage from each other on the conventional high-frequency filter is not required, making it possible to reduce the size of the high-frequency filter.

Figure 4A:
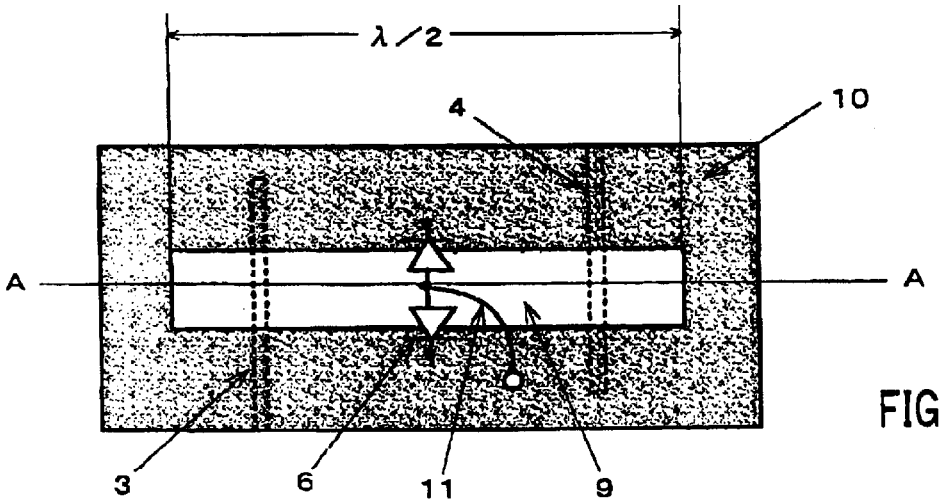
FIGS. 4A and 4B are a plan view and a cross-sectional view of a high-frequency filter according to a second embodiment of the present invention.
Figure 4B:
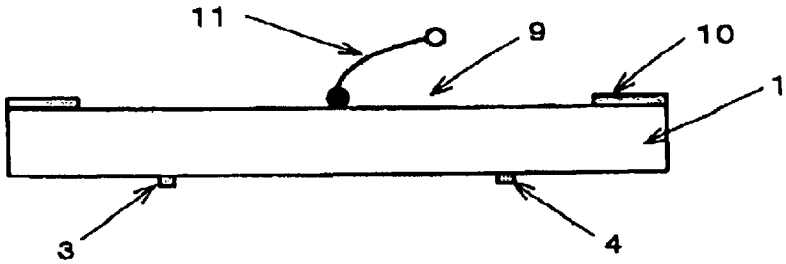

A high-frequency filter according to a second embodiment of the present invention will be described below with reference to FIGS. 4A and 4B.

In the first embodiment, the resonator is constructed using the coplanar line structure as the coplanar transmission line. In the second embodiment, a resonator is constructed using a slot line structure as a coplanar transmission line.

The high-frequency filter includes metal conductor 10 disposed on one main surface of substrate 1 which is made of a dielectric material or the like and having rectangular opening 9 defined therein. Opening 9 provides a slot line, making up a resonator as a high-frequency filter. Opening 9 has a length of about $\lambda/2$ where $\lambda$ represents the wavelength of the resonant frequency. The resonator will hereinafter be referred to as an SL (slot line) resonator. The slot line is a balanced transmission line in which a high-frequency signal progresses under an electric field generated between metal conductor portions on the opposite sides of opening 9 and a magnetic field generated due to the electric field. The both ends (left and right ends as shown) of the SL resonator (opening 9) are closed, and electrically functioning as short-circuited ends.

A pair of variable-capacitance diodes 6 whose anodes are connected to each other are disposed on the one main surface of substrate 1 in a central region of opening 9. Variable-capacitance diodes 6 has respective cathodes connected to the portions of metal conductor 10 on the opposite sides of opening 9 by soldering. Supply line 11 for applying a control voltage to variable-capacitance diodes 6 has an end connected to the anodes thereof at a midpoint which divides the slot line (opening 9) into equal segments. A ground line (not shown), which is paired with supply line 11, is connected to metal conductor 10. Variable-capacitance diodes 6 may alternatively have their cathodes connected to each other and their anodes connected to metal conductor 10.

Input line 3 is mounted on the other main surface of substrate 1 and extends transversely across the SL resonator near the left end (as shown) of the SL resonator. Similarly, output line 4 is mounted on the other main surface of substrate 1 and extends transversely across the SL resonator near the right end (as shown) of the SL resonator. Input line 3 and output line 4 extend vertically as shown in FIG. 4A and reach respective edges of substrate 1. Specifically, input line 3 and output line 4 extend in a direction perpendicular to the direction in which the SL resonator extends. Input line 3 and output line 4 cooperate with metal conductor 10 on the one main surface of substrate 1 in forming microstrip lines, which are electrically connected to the slot line (opening 9) as the SL resonator by electromagnetic coupling.

With the high-frequency filter thus constructed, input/output resonant points where the resonant frequency is higher than the resonant frequency of the SL resonator are produced on the high-frequency filter depending on a boundary condition based on the positions of input line 3 and output line 4 disposed on the other main surface of substrate 1 and extending transversely across the SL resonator. As with the characteristic curve shown in FIG. 3, an attenuating pole P is formed in a high-frequency range of the band characteristics of the SL resonator, with the result that the attenuation gradient of the high-frequency filter is made steeper.

Because the portions of metal conductor 10 on the opposite sides of the slot line (opening 9) are connected by variable-capacitance diodes 6, the resonant frequency of the resonator is made variable by changing the capacitances of variable-capacitance diodes 6 with the control voltage applied thereto, as with the first embodiment. Since variable-capacitance diodes 6 are positioned in an electric field generated between the metal conductor portions disposed on the opposite sides of the opening of the slot line, the electric length of the opening is equivalently changed when the capacitances of variable-capacitance diodes 6 are changed.

According to the second embodiment, as with the first embodiment, since the resonator is arranged in the coplanar structure as the coplanar line (coplanar waveguide), the opposite terminals of variable-capacitance diodes 6 can be connected in one plane, and hence variable-capacitance diodes 6 can be surface-mounted. Unlike the conventional high-frequency filter shown in FIG. 1 which employs microstrip lines, it is not necessary to form via holes 7 in substrate 1 according to a perforating process. As any inductive components which would otherwise be caused by via holes 7 are negligible, the high-frequency filter can be designed and manufactured with ease, and can be fabricated with increased accuracy at increased productivity.

The control voltage is applied to variable-capacitance diodes 6 through supply line 11 connected to the positions corresponding the midpoint which divides slot line (opening 9) into two equal lengths. Therefore, any effect that the application of the control voltage has on the resonance characteristics can be ignored. Consequently, an LPF which has heretofore been necessary to isolate the high-frequency signal and the control voltage from each other on the conventional high-frequency filter is not required, making it possible to reduce the size of the high-frequency filter.

A high-frequency filter according to a third embodiment of the present invention will be described below with reference to FIG. 5. In the above embodiments, the high-frequency filter comprises a single resonator. In the third embodiment, however, a high-frequency filter comprises a plurality of resonators that are connected in cascade. Specifically, a plurality of CPW resonators each according to the first embodiment are connected in cascade.

Figure 5:
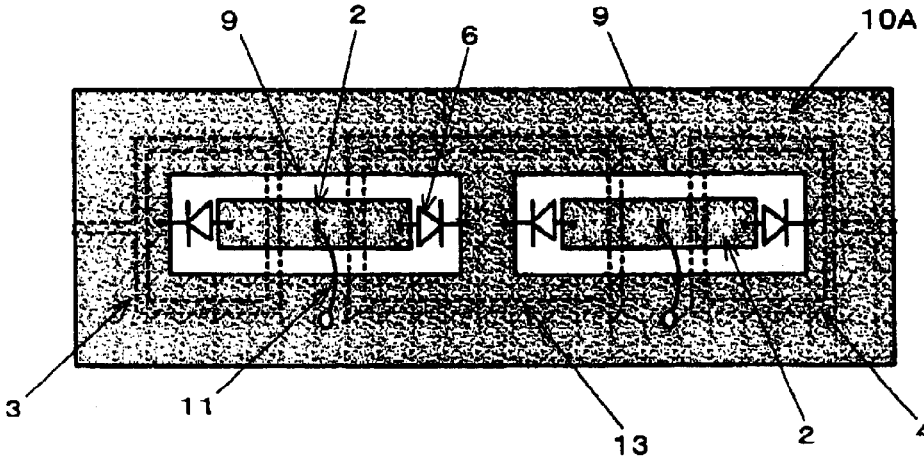
FIG. 5 is a plan view of a cascaded high-frequency filter according to a third embodiment of the present invention.

The high-frequency filter includes ground conductor 10A disposed on one main surface of substrate 1 and having two openings 9 defined therein which are spaced from each other in the direction in which each opening 9 extends, i.e., in the horizontal direction in FIG. 5, with signal lines 2 disposed in openings 9, respectively, thus making up a plurality (two in the illustrated embodiment) of CPW resonators arranged in the longitudinal direction thereof.

As with the first embodiment, variable-capacitance diodes 6 are connected between signal lines 2 and ground conductor 10A at the left and right ends of the CPW resonators (openings 9). Supply lines 11 for applying a control voltage to variable-capacitance diodes 6 are connected to the CPW resonators, i.e., signal lines 2, at respective longitudinal midpoints thereof which divide signal lines 2 into equal lengths.

As with the first embodiment, input line 3 and output line 4 are mounted on the other main surface of substrate 1 at respective left and right ends thereof. Input line 3 comprises a closed loop disposed at the left end of the left CPW resonator (signal line 2) in surrounding relation to variable-capacitance diode 6 connected to the left end of the left CPW resonator and extending transversely across signal line 2, and an extension extending from the closed loop to the left edge of substrate 1. Similarly, output line 4 comprises a closed loop disposed at the right end of the right CPW resonator in surrounding relation to variable-capacitance diode 6 connected to the right end of the right CPW resonator and extending transversely across signal line 2, and an extension extending from the closed loop to the right edge of substrate 1. Coupling line 13 is disposed in a central area of the other main surface of substrate 1 and has a closed loop surrounding the near ends of signal lines 2 and variable-capacitance diodes 6 and extending transversely across signal lines 2. Coupling line 13 cooperates with ground conductor 10A in forming a microstrip line, and is electromagnetically coupled to the CPW resonators, making up a transmission line.

Input and output lines 3, 4 and coupling line 13 which are disposed on the other main surface of substrate 1 across the CPW resonator (coplanar line) disposed on the one main surface of substrate 1 produce input/output resonant points where the frequency is higher than the resonant frequencies of the CPW resonators. Thus, an attenuating pole P is formed in a high-frequency range of the band characteristics of each of the CPW resonators, with the result that the attenuation gradient in the high-frequency range in the transmission characteristics of the resonators is made steeper. Since the CPW resonators (i.e., filters) are connected in cascade, the high-frequency filter can provide transmission characteristics with a much steeper attenuation gradient by equalizing the resonant frequencies of the CPW resonators. The high-frequency filter can also provide filter characteristics of a wider band by shifting the central frequencies of the CPW resonators.

As with the previous embodiments, the resonant frequencies of the CPW resonators can be changed by the control voltage that is applied to variable-capacitance diodes 6. Furthermore, since variable-capacitance diodes 6 are mounted on one main surface of the substrate, they can be surface-mounted. Since a perforating process for producing via holes can be dispensed with and the effect of inductive components can be ignored, the high-frequency filter can be fabricated with increased accuracy at increased productivity. Supply lines 11 are connected to the midpoints which divide the CPW resonators into equal lengths for applying a control voltage to variable-capacitance diodes 6, any effect that the application of the control voltage has on the resonance characteristics can be ignored. Consequently, an LPF is not required, and the size of the high-frequency filter is reduced.

Figure 6:
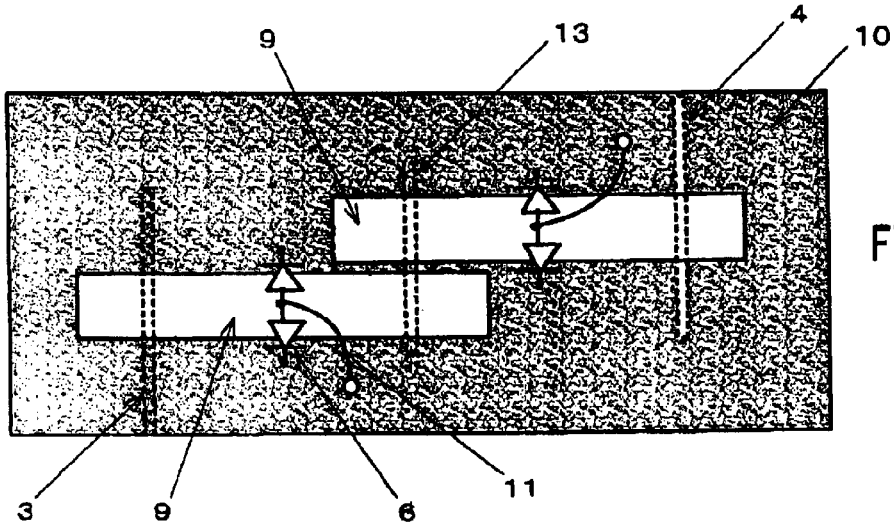
FIG. 6 is a plan view of a cascaded high-frequency filter according to a fourth embodiment of the present invention.

A high-frequency filter according to a fourth embodiment of the present invention will be described below with reference to FIG. 6. In the third embodiment, the high-frequency filter comprises a plurality of CPW resonators connected in cascade. In the fourth embodiment, however, a plurality of SL resonators each according to the second embodiment are connected in cascade.

The high-frequency filter includes metal conductor 10 disposed on one main surface of substrate 1 and having two SL resonators (openings 9) displaced from each other vertically (as shown) and partly overlapping each other.

As with the second embodiment, a pair of variable-capacitance diodes 6 is connected to metal conductor 10 in a central region of each of the SL resonators. A supply line 11 for applying a control voltage to variable-capacitance diodes 6 is connected to variable-capacitance diodes 6 at a midpoint which divides each of the SL resonators into equal lengths.

Input line 3 and output line 4 are mounted on the other main surface of substrate 1 at respective left and right end portions of signal line 2. Input line 3 extends transversely across the left SL resonator (opening 9) near the left end (as shown) of the SL resonator. Similarly, output line 4 extends transversely across the right SL resonator (opening 9) near the right end (as shown) of the SL resonator. Straight coupling line 13 is disposed in a central area of the other main surface of substrate 1 and extends transversely across both openings 9. Coupling line 13 cooperates with metal conductor 10 in forming a microstrip line, which is electromagnetically coupled to the SL resonators, making up a transmission line.

In the thus configured high-frequency filter, input and output lines 3, 4 and coupling line 13 which are disposed on the other main surface of substrate 1 across the SL resonators disposed on the one main surface of substrate 1 produce input/output resonant points where the frequency is higher than the resonant frequencies of the SL resonators. Thus, an attenuating pole P is formed in a high-frequency range of the band characteristics of each of the SL resonators, with the result that the attenuation gradient in the high-frequency range in the transmission characteristics of the resonators is made steeper. Since the SL resonators (filters) are connected in cascade, the high-frequency filter can provide transmission characteristics with a much steeper attenuation gradient by equalizing the resonant frequencies of the SL resonators. The high-frequency filter can also provide filter characteristics of a wider band by shifting the central frequencies of the SL resonators.

As with the previous embodiments, the resonant frequencies of the SL resonators can be changed by the control voltage that is applied to variable-capacitance diodes 6. Furthermore, since variable-capacitance diodes 6 are mounted on one main surface of the substrate, they can be surface-mounted. Since a perforating process for producing via holes can be dispensed with and the effect of inductive components can be ignored, the high-frequency filter can be fabricated with increased accuracy at increased productivity. Supply lines 11 are connected to the midpoints which divide the SL resonators into equal lengths for applying a control voltage to variable-capacitance diodes 6, any effect that the application of the control voltage has on the resonance characteristics can be ignored. Consequently, an LPF is not required, and the size of the high-frequency filter is reduced.

The high-frequency filters according to the above embodiments are of a symmetrical configuration with respect to input and output lines 3, 4. Therefore, input and output lines 3, 4 may be switched around. Stated otherwise, the high-frequency filter may be used in such a mode that a signal is input from output line 4 and a signal is output from input line 3.

While the present invention has been described above with respect to the preferred embodiments, the present invention is not limited to the preferred embodiments descried above.

In the first embodiment, the opposite ends of the CPW resonator are open ends. However, one of the opposite ends of the CPW resonator may be an open end, the other of the opposite ends of the CPW resonator may be a short-circuited end, and the signal line may have a length of $\lambda/4$. The high-frequency filter thus modified may be smaller in size than the high-frequency filter in which the opposite ends of the CPW resonator are open ends and the signal line has a length of $\lambda/2$. However, inasmuch as it is difficult for the modified high-frequency filter to incorporate variable-capacitance diodes for controlling the resonant frequency, the modified high-frequency filter should preferably employ an integrated circuit (IC) having a variable-capacitance capability. Alternatively, a high-capacitance capacitor may be connected to the short-circuited end for effectively short-circuiting a high-frequency signal, and a supply terminal for applying a control voltage may be connected to the short circuited end, so that the capacitances of the variable-capacitance diodes can be controlled without degrading the high-frequency signal.

Figure 7:
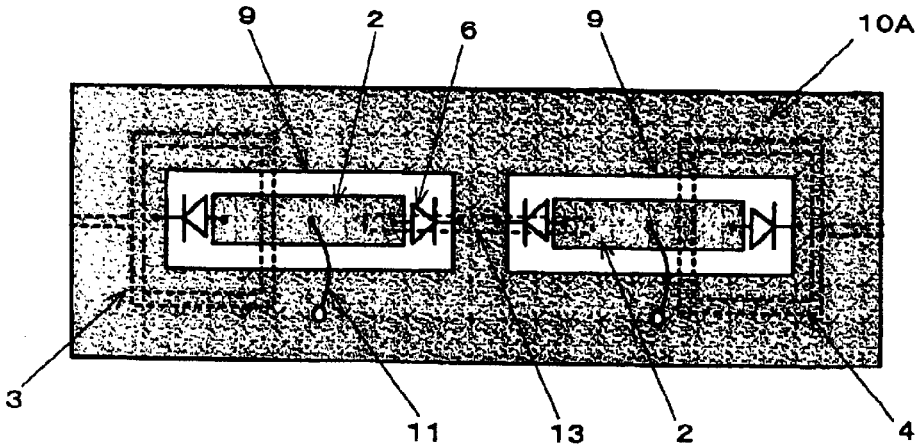
FIG. 7 is a plan view of a high-frequency filter according to another embodiment of the present invention.

In the third embodiment (see FIG. 5), coupling line 13 as the closed loop interconnects the two CPW resonators. However, as shown in FIG. 7, the two CPW resonators may be interconnected by coupling line 13 disposed on the other main surface of substrate 1. Coupling line 13 is disposed on a common central line across the CPW resonators, cooperates with ground conductor 10A in forming a microstrip line, and electromagnetically couples to signal lines 2 of the CPW resonators via substrate 1. With this arrangement, input and output lines 3, 4 are effective to produce an attenuating pole P. However, use of coupling line 13 as the closed loop makes steeper the attenuation gradient in the transmission characteristics of the high-frequency filter.

In the fourth embodiment (see FIG. 6), coupling line 13 which forms a microstrip line interconnects the two SL resonators. However, the length over which the two SL resonators overlap each other may be set to about $\lambda/4$, and the two SL resonators may be electromagnetically coupled to each other.

Figure 8:
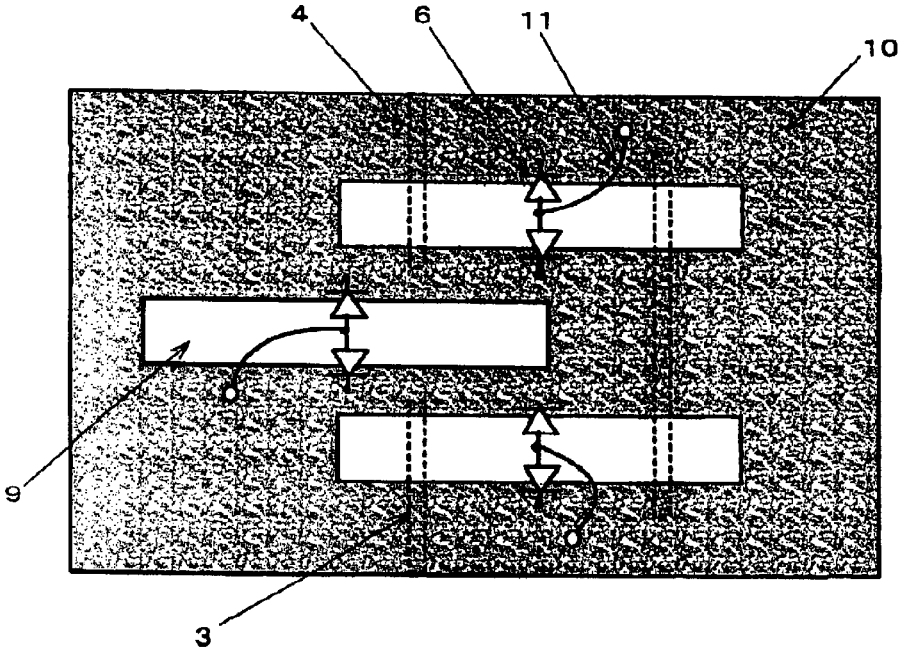
FIG. 8 is a plan view of a high-frequency filter according to still another embodiment of the present invention.

In the above embodiments, the attenuating pole P is positioned in the high-frequency range of the filter characteristics. For example, in the second embodiment, input and output lines 3, 4 serving as a microstrip line extending transversely across the SL resonator produce the attenuating pole P in the high-frequency range. However, a plurality of resonators may be connected in a skipped or interlaced manner to produce an attenuating point also in a low-frequency range. For example, as shown in FIG. 8, first and second SL resonators 9 are disposed in vertical alignment on one main surface of substrate 1, and a third SL resonator 9 is disposed intermediate between first and second SL resonators 9 in overlapping relation to first and second SL resonators 9 by a length of $\lambda/4$. Input line 3 and output line 4 which are spaced a distance d from the slot line are disposed across ends of first and second SL resonators 9 which overlap third SL resonator 9. Coupling line 13 comprising a microstrip line is disposed across the other ends of first and second SL resonators 9.

Input line 3 and output line 4 thus positioned are effective in producing an attenuating pole in the high-frequency range of the filter characteristics. Since coupling line 13 is provided, new resonant points are produced by a boundary condition based on the position of coupling line 13. Inasmuch as an electric length corresponding to these resonant points is made longer by coupling line 13 than the line length of SL resonators 9, resonant points are produced at frequencies lower than the resonant frequencies of the SL resonators. Therefore, an attenuating pole P is produced in the low-frequency range of the filter characteristics. Therefore, attenuating poles P are produced in both the high- and low-frequency ranges of the filter characteristics, making the attenuation gradient much steeper.

In the above embodiments, substrate 1 is made of a dielectric material. However, substrate 1 may be made of a magnetic material or a semiconductor material. While the distances from input line 3 and output line 4 to the ends of signal line 2 or the ends of the slot line are the same as each other, these distances may be different from each other. In this case, resonant points generated in two areas may be controlled to change the attenuating characteristics. While the variable-capacitance diodes are used to control the resonant frequency, variable-reactance elements whose reactance including inductance is variable may be used to control the resonant frequency. Since the resonator is of a coplanar structure, not only surface-mountable variable-reactance elements, but also beam lead semiconductor devices, flip-chip ICs to be mounted by bumps, etc. may be mounted on the resonator highly accurately and efficiently.

Resonators may be cascaded in not only two stages, but also three or more stages.

What is claimed is:

1. A high-frequency filter comprising:

a substrate;

a metal conductor disposed on a first main surface of said substrate;

a resonator comprising a transmission line of a coplanar structure which is made of said metal conductor, said resonator including a slot line resonator having a transmission line as a slot line;

input and output lines disposed on a second main surface of said substrate transversely across said resonator and electromagnetically coupled to said resonator;

a pair of variable reactance elements having respective first polarity terminals and respective second polarity terminals, said first polarity terminals being connected to each other, and said second polarity terminals being connected to metal conductor portions which are located on opposite sides of an opening defined in said slot line, respectively; and means for applying a control voltage between an interconnection point of said pair of variable-reactance elements and said metal conductor.

2. The high-frequency filter according to claim 1, wherein said pair of variable-reactance elements are disposed over said opening defined in said slot line.

3. The high-frequency filter according to claim 2, wherein each of variable reactance devices comprises a variable-capacitance diode.

4. The high-frequency filter according to claim 1, wherein said input line corresponds to a first end of said slot line, and said output line corresponds to a second end of said slot line.

5. The high-frequency filter according to claim 4, wherein said input line and said output line extend in a direction substantially perpendicular to the direction in which said slot line extends.

6. The high-frequency filter according to claim 1, wherein said substrate comprises a dielectric substrate.

7. A high-frequency filter for use as a cascaded filter, comprising:

a substrate;

a metal conductor disposed on a first main surface of said substrate;

a plurality of resonators disposed on said first main surface and each comprising a transmission line of a coplanar structure which is made of said metal conductor, wherein each resonator includes a slot line resonator having a transmission line as a slot line, said slot line resonators extending substantially parallel to each other on said first main surface, overlapping each other, and having ends displaced from each other;

input and output lines disposed on a second main surface of said substrate transversely across said resonator and electromagnetically coupled to said resonator;

a coupling line disposed on said second main surface and electromagnetically coupling said slot line resonators;

a pair of variable reactance elements for each slot line connecting metal conductor portions which are disposed over an opening defined in said slot line and having respective first polarity terminals and respective second polarity terminals, said first polarity terminals being connected to each other, and said second polarity terminals being connected to metal conductor portions which are located on opposite sides of an opening defined in said slot line, respectively; and means for applying a control voltage between an interconnection point of each pair of variable-reactance elements and said metal conductor.

8. The high-frequency filter according to claim 7, wherein said input line corresponds to a first end of said slot line, and said output line corresponds to a second end of said slot line.

9. A high-frequency filter comprising:

a substrate;

a metal conductor disposed on a first main surface of said substrate;

a resonator comprising a transmission line of a coplanar structure which is made of said metal conductor; and input and output lines disposed on a second main surface of said substrate transversely across said resonator and electromagnetically coupled to said resonator;

wherein said resonator comprises a coplanar line resonator comprising a transmission line as a coplanar line.

10. The high-frequency filter according to claim 9, further comprising:

a pair of variable-reactance devices interconnecting opposite ends of a signal line disposed in an opening defined in said coplanar line and said metal conductor; and means for applying a control voltage for said variable-reactance devices to an electric midpoint of said signal line.

11. The high-frequency filter according to claim 10, wherein each of variable-reactance devices comprises a variable-capacitance diode.

12. The high-frequency filter according to claim 9, for use as a cascaded filter, wherein said high-frequency filter has a plurality of said coplanar line resonators disposed on said first main surface and arranged in a longitudinal direction of said substrate, further comprising:

a coupling line disposed in said second main surface and electromagnetically coupling adjacent two of said coplanar line resonators.

13. The high-frequency filter according to claim 12, further comprising:

a pair of variable-reactance devices interconnecting opposite ends of a signal line disposed in an opening defined in said coplanar line and said metal conductor; and means for applying a control voltage for said variable-reactance devices and said applying means are provided for each coplanar line resonator.

14. The high-frequency filter according to claim 13, wherein said input line has a closed loop corresponding to a first end of said signal line and an extension extending from said closed loop, and said output line has a closed loop corresponding to a second end of said digital line and an extension extending from said closed loop of the output line.

15. The high-frequency filter according to claim 12, wherein said coplanar line resonator comprises an opening defined in a ground conductor disposed on said first main surface and a signal line disposed in said opening, said signal line having open opposite ends.

* * * * *